US009366478B2

(12) United States Patent
DiMenichi

(10) Patent No.: US 9,366,478 B2
(45) Date of Patent: Jun. 14, 2016

(54) STUMP SOCK DRYER

(71) Applicant: Michael Angelo DiMenichi, Trabuco Canyon, CA (US)

(72) Inventor: Michael Angelo DiMenichi, Trabuco Canyon, CA (US)

(73) Assignee: Michael A. DiMenichi, Roseville, CA (US)

( * ) Notice: Subject to any disclaimer, the term of this patent is extended or adjusted under 35 U.S.C. 154(b) by 134 days.

(21) Appl. No.: 14/454,725

(22) Filed: Sep. 29, 2014

(65) Prior Publication Data

US 2016/0091247 A1 Mar. 31, 2016

(51) Int. Cl.
*F26B 9/04* (2006.01)
*F26B 9/00* (2006.01)

(52) U.S. Cl.
CPC ..... *F26B 9/003* (2013.01)

(58) Field of Classification Search
CPC ..... F26B 5/00; F26B 9/00; F26B 9/04; A61F 2/00; A61F 2/80; A61F 2/5046; A61F 13/08; A61F 13/00034; D06F 59/00; D06F 59/06
USPC ..... 34/104, 105; 602/44, 53, 76; 424/65, 424/66, 68; 623/32, 34, 53; 2/22, 36, 239; 223/77
See application file for complete search history.

(56) References Cited

U.S. PATENT DOCUMENTS 2,175,661 A * 10/1939 Gordon ..... D06F 59/06 12/114.6
2,440,398 A * 4/1948 Fenwick ..... F26B 9/003 34/105
2,545,479 A * 3/1951 Loutz ..... D06F 59/06 223/77
3,299,529 A * 1/1967 Roberts ..... A47L 23/20 219/400
3,990,616 A * 11/1976 Thompson ..... D06C 5/00 223/77
4,541,554 A * 9/1985 Endress ..... A61F 2/7812 223/66
5,199,188 A * 4/1993 Franz ..... F26B 21/006 34/104
5,571,208 A * 11/1996 Caspers ..... A61F 2/5046 623/32
5,658,354 A * 8/1997 Norvell ..... A61F 2/7812 602/63
5,720,108 A * 2/1998 Rice ..... A47L 23/205 34/104
5,862,606 A * 1/1999 Jannach ..... D06F 17/04 134/166 R
7,121,017 B2 * 10/2006 DuRapau ..... D06F 59/04 34/381

(Continued)

FOREIGN PATENT DOCUMENTS

CH 679071 A5 * 12/1991 ..... A47L 23/205
GB 1361935 A * 7/1974 ..... A61F 2/7812
GB WO 9705835 A1 * 2/1997 ..... A61F 2/7812

*Primary Examiner* — Stephen M Gravini

(57) ABSTRACT

A stump sock dryer is configured to rapidly move air through a stump sock quickly drying the stump sock. The stump sock dryer includes a fan capable of moving air. Ducting is connected to the fan such that the fan moves the air through the ducting. An air delivery tube is mechanically coupled to the ducting such that the air moves through the ducting and into the air delivery tube. An air delivery nozzle is connected to the air delivery tube sufficiently sized to accommodate a stump sock. The fan can blow air through the ducting into the air delivery tube and through the air delivery nozzle into the stump sock quickly drying the stump sock.

1 Claim, 6 Drawing Sheets

(56) References Cited

U.S. PATENT DOCUMENTS 7,430,816 B1 * 10/2008 Lozenski ..... A47L 23/205 34/104
7,526,876 B2 * 5/2009 Carey ..... A47L 23/205 34/103
8,898,929 B2 * 12/2014 Stewart ..... D06F 59/04 134/103.2
8,955,233 B2 * 2/2015 Dean ..... F26B 5/12 211/205
8,955,234 B2 * 2/2015 Williams ..... 211/85.7
8,966,781 B1 * 3/2015 McKernan ..... A61L 2/07 211/189
8,984,766 B2 * 3/2015 Williams ..... F26B 20/00 34/381
2005/0240282 A1 * 10/2005 Rush ..... A61F 2/60 623/26
2007/0261263 A1 * 11/2007 Lee ..... F26B 21/001 34/201
2009/0083989 A1 * 4/2009 Wang ..... D06F 59/02 34/442
2010/0312360 A1 * 12/2010 Caspers ..... A61F 2/66 623/34
2012/0004738 A1 * 1/2012 Westrate ..... A61F 2/78 623/36
2012/0186098 A1 * 7/2012 Williams ..... D06F 59/02 34/240
2015/0107131 A1 * 4/2015 Barnes ..... F26B 21/004 34/487
2016/0091247 A1 * 3/2016 DiMenichi ..... F26B 9/003 34/104

* cited by examiner

STUMP SOCK DRYER

BRIEF DESCRIPTION OF THE FIGURES

Complete unit breakdown FIG. 1/6
Fan and Bracket breakdown FIG. 2/6
Fan and Bracket assembly FIG. 3/6
Nozzle breakdown FIG. 4/6
Nozzle assembly FIG. 5/6
Complete unit with stump sock FIG. 6/6

The detailed description of this invention is made below with reference to the accompanying figures. This embodiment is constructed from standard materials from hardware and electronics stores: Square plastic tube and parts 1, 10. Schedule 80 pipe and fittings 11, 12, 13, 17. A/C toggle switch 8. A/C box fan 3 and grill 5. Standard 2 wire 125 V A/C power cord 6. Rubber feet 9. Rollers 16. Various bolts, nuts, screws and pop rivets can be used as fasteners F. Different types of standard fan mounting hardware 4 can be used, as seen in FIG. 1/6 and FIG. 2/6.

Other embodiments could be constructed from different custom molded or extruded parts to improve the appearance and customer appeal without changing the concept.

DETAILED DESCRIPTION OF THE FIGURES

Figure 1:
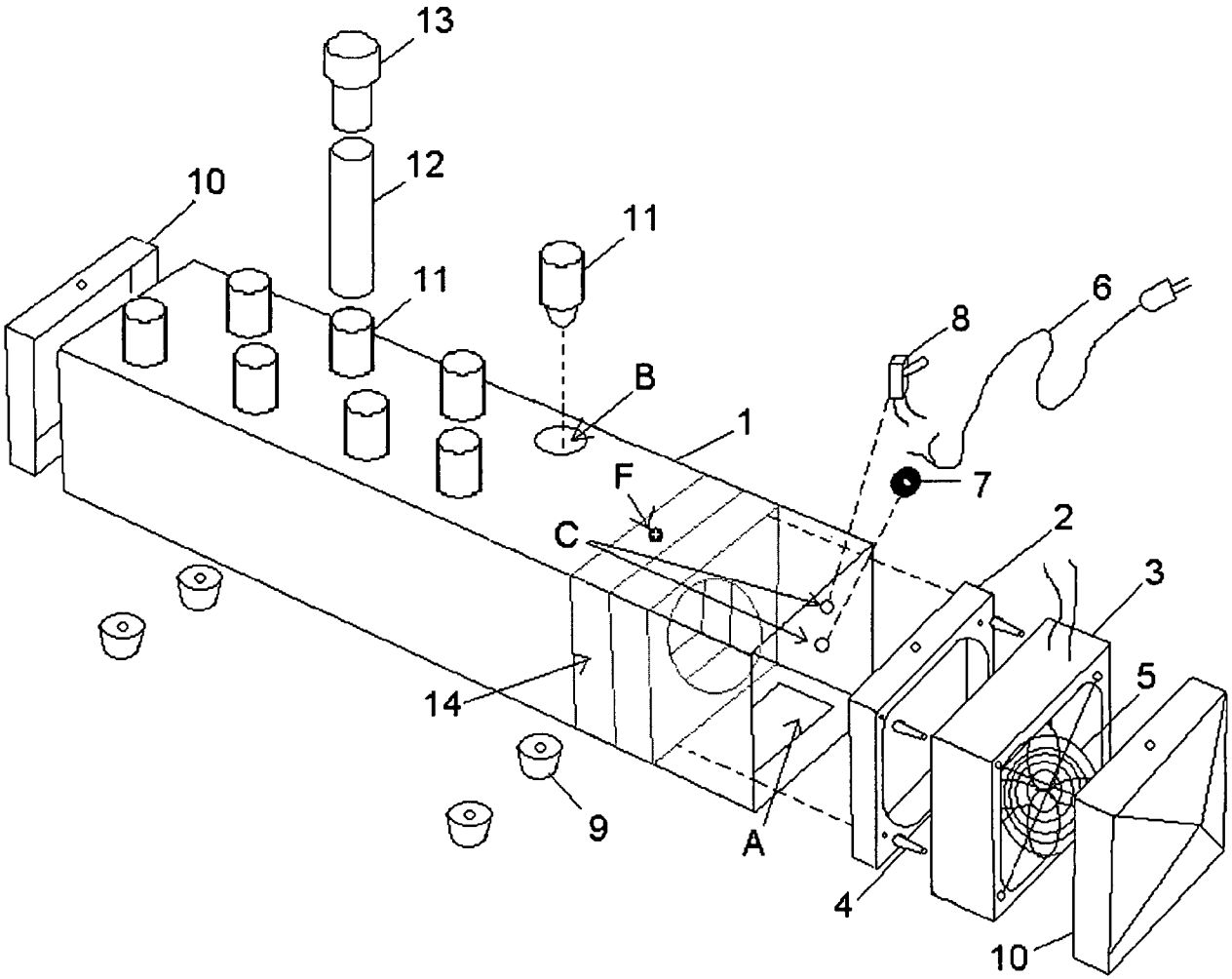

Main Assembly FIG. 1/6

Duct 1 is a square plastic tube cut to desired length. Air inlet A is a hole cut into the bottom near one end of duct 1 and spanning the width of duct 1. 5 to 8 holes B are drilled into the top of duct 1 near the edge in a symmetrical staggered formation to accommodate permanently attaching air tube adapters 11 to duct 1. 2 holes C are drilled into the back of duct 1 adjacent to air inlet A, sufficient to accommodate switch 8 and passing power cord 6 with strain relief 7 through duct 1.

Figure 3:
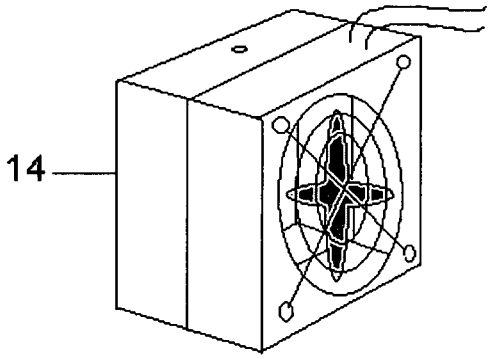

Fan and bracket assembly 14 FIG. 3/6 is inserted into the end of duct 1 to where grill 5 is just beyond air inlet A. Fan mounting bracket 2 is attached to duct 1 by screws or pop rivets F. Power cord 6 is fed through strain relief 7 and then through one of the holes C in back of duct 1 and wired together with switch 8 in the proper way so that switch 8 controls the on/off operation of fan 3. Switch 8 is mounted through the remaining hole C to duct 1 with the toggle on the outside.

Feet 9 are attached to the bottom of duct 1 by glue, screws, or pop rivets F in such a way as to provide a stable base for the dryer. End caps 10 are placed on both ends of duct 1. Air tubes 12 of a length that is appropriate for the length of stump socks are inserted into air tube adapters 11. Nozzle assembly 13 is placed on top of air tubes 12.

Figure 2:
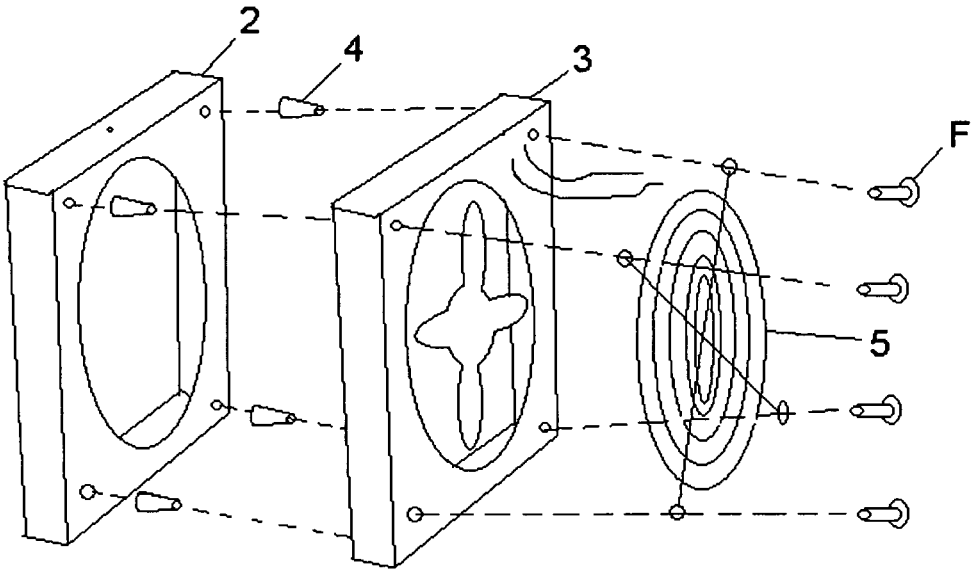

Fan and Bracket FIG. 2/6

Fan mounting bracket 2 is plastic molded in the shape of a hollow cube cut in half resembling a pan. A round hole to match the size of fan 3 is cut into the end to allow air from fan 3 to pass through fan mounting bracket 2. Holes are drilled in the corners to accommodate fan mounts 4. Fan mounts 4 are inserted into the holes in fan mounting bracket 2. Fan 3 is attached to fan mounting bracket 2 by way of fan mounts 4. Grill 5 is attached to fan 3 opposite the bracket by way of screws or pop rivets F. The finished part comprises the fan and bracket assembly 14 FIG. 3/6, the dimensions of which are such that it can slide easily and snugly into the duct 1

Figure 4:
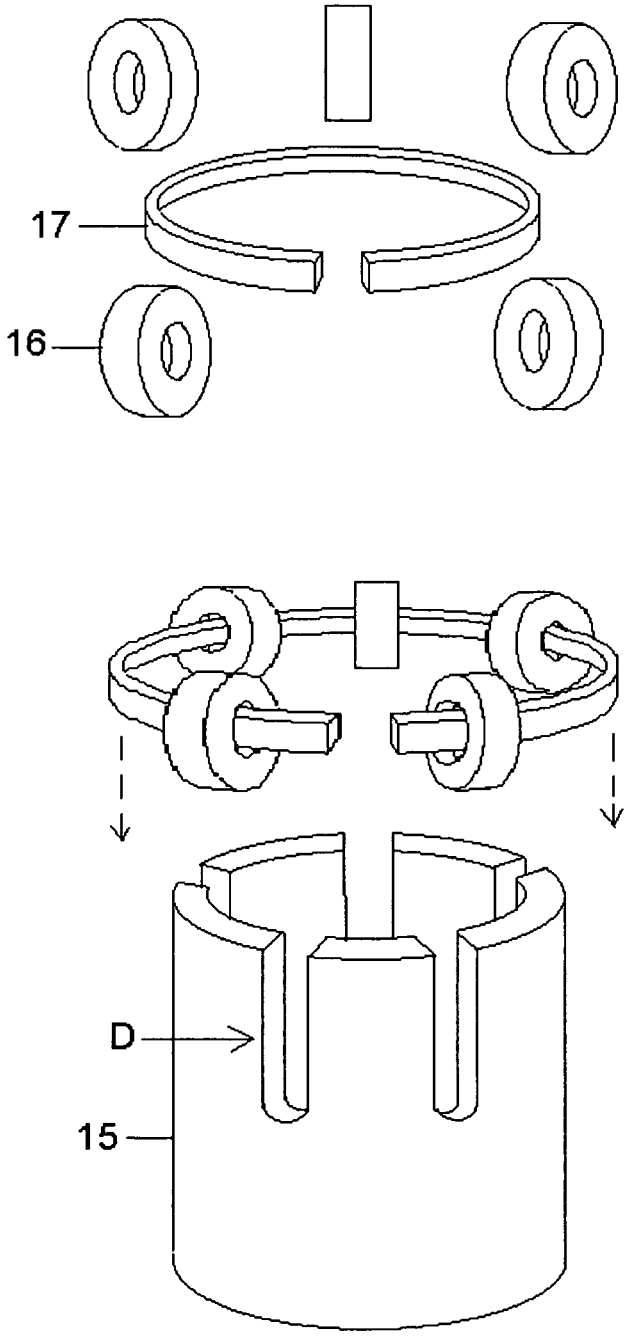

Nozzle FIG. 4/6

Figure 5:
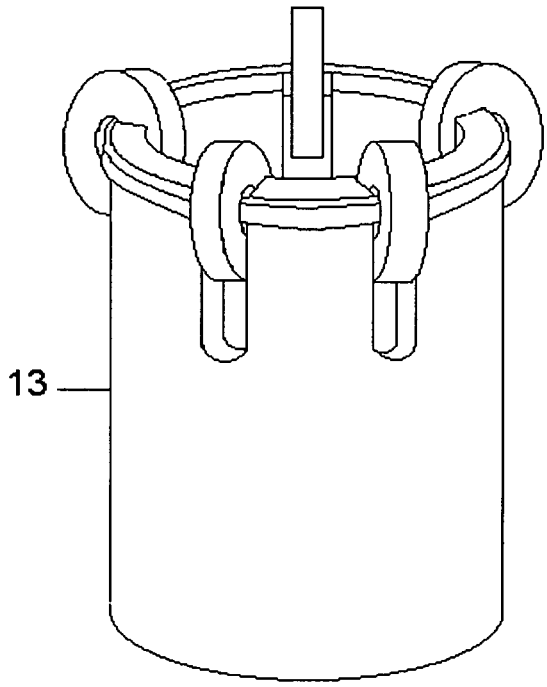

Nozzle body 15 is formed by cutting 5 symmetrically spaced openings D into the upper end of a plastic coupler. 5 nylon rollers 16 will spin freely within these openings. Rollers 16 will spin on plastic ring 17 made by cutting a section from a plastic pipe. Ring with rollers in place is cemented to top of the coupler with rollers positioned in openings D. The finished part comprises the Nozzle assembly 13 FIG. 5/6.

Figure 6:
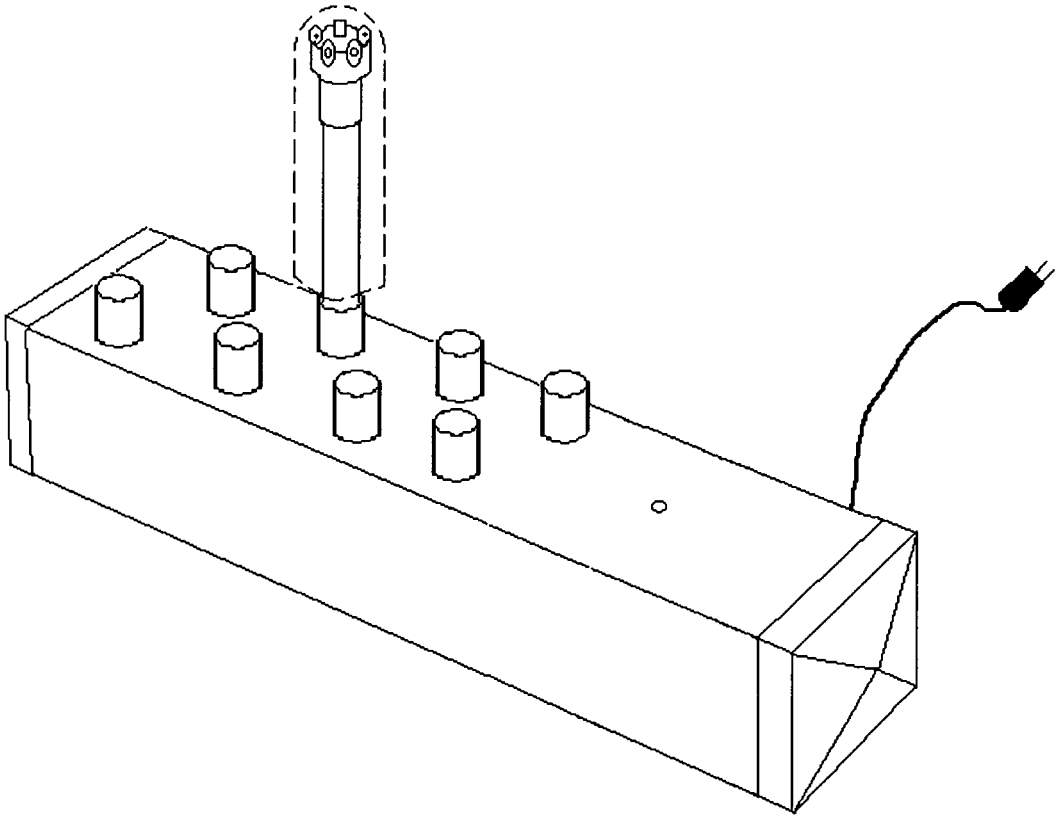

Use of Assembled Stump Sock Dryer FIG. 6/6

Once assembled, wet stump socks are positioned over the nozzles and air tubes. The device is plugged into an A/C outlet. The power switch is flipped to on position.

BACKGROUND OF THE INVENTION

The embodiments herein relate generally to personal appliances, for people wearing prosthetic.

DETAILED BACKGROUND

Prosthetic limbs are constructed of hard, durable materials, such as graphite. The limb stump must be covered and protected from pressure injury, as it is under stress and/or weight bearing conditions for hours each day. Special gel-impregnated socks or liners are worn to conform to the shape of the limb stump to create a cushion and a strong frictional attachment to the skin of the prosthetic wearer. Because these gel socks and liners are air impermeable, the skin tends to be constantly moist within the sock. For health reasons, and per Doctor and sock manufacturer recommendations, it is important for these socks and liners to be thoroughly washed and dried after each day of wear. The socks must be gently washed and cool air dried, as recommended by the manufacturer, both inside and out. A need exists for an efficient dryer that can be used by each individual to dry his/her stump socks at home. There are multiple factors involved in effectively drying stump socks. All factors must be considered and addressed in order to have a machine that dries socks properly.

These considerations are.

Stump socks are long narrow tubes that are open on one end for receiving the amputation stump and closed on the opposite end, this makes it difficult to move the air necessary for drying throughout the sock. They are air impermeable making it impossible to move air through the material itself. The size, shape and construction make it challenging to mount and dismount socks on a dryer. Mounting the sock on a dryer should not stretch or deform the sock. Heat or heated air cannot be used as it compromises the integrity of the material in a stump sock. Air movement through the entire length of the stump sock must be guaranteed to completely dry the entire inside of the stump sock. Due to the daily cycle of shing and drying most amputees have multiple sets of stump socks. Being able to dry multiple socks at one time is a beneficial factor in stump sock care.

There exists a need in the art for a drying device for prosthetic socks and liners that can speed up the drying time, and address all the factors involved in drying, to result in socks that are dried thoroughly from tip to opening.

DISCUSSION OF PRIOR ART

In examining prior art it can be concluded there is no device that implements a mechanism to incorporate all that is necessary for a well-designed stump sock dryer that can be used in the home by an average amputee. Almost all prior art is targeted to dry socks or apparel that fit on a normal persons foot leg or hand, many mimicking the shape thereof often having a bend similar to a foot. Because of the long slender straight shape of a stump sock these are not a proper design. Many use heat, which is simply not acceptable. Many are only hangers or shapers, and do not provide airflow through the inside of the stump sock. Many are made to dry only 2 items at a time. Some do not provide proper direction of airflow. Machines for industrial or very high volume use do not fill the need for home use by the individual amputee. The following cites some examples.

| Citing Patent | Filing Date | Publication Date | Applicant/Title |
|---|---|---|---|
| No air flow mechanism: | | | |
| U.S. Pat. No. 2,400,203A | 20 Jan. 1945 | 14 May 1946 | Alexander G. Kerby/ Sock Drier |
| U.S. Pat. No. 3,990,616A | 23 Dec. 1975 | 6 Nov. 1976 | Philip W. Thompson/ Dryer and Shaper Support for Clothing |
| Heating element used: | | | |
| U.S. Pat. No. 5,287,636A | 25 Jan. 1993 | 22 Feb. 1994 | Andre LaFleur, Real Lanoix/Tubular Drying Apparatus for Footwear and Handwear |
| U.S. Pat. No. 4,136,464 | 12 Oct. 1977 | 30 Jan. 1979 | Alexander Hay/Boot Drying Apparatus |
| Allows for 2 posts only (2 socks per dry cycle) | | | |
| U.S. Pat. No. 4,768,293A | 11 May 1987 | 6 Sep. 1988 | Michael G. Kaffka/ Footwear Drying Apparatus |
| Very large, complex machine-not for home use: | | | |
| U.S. Pat. No. 4,231,236 | 7 Apr. 1978 | 4 Nov. 1980 | Bruno G. Tratta/ Dyeing Machine Particularly for Dyeing and Drying Stocking Articles |
| Heavy-duty, designed for firefighters' boots with angular posts attached for gloves which would be too short for additional socks): | | | |
| US20050097768 | 27 Oct. 2004 | 12 May 2005 | John Burns/Apparatus and Methods for Drying Gloves and Boots |

The only patented machine that addresses the specific need to dry prosthesis stump socks is

| Citing Patent | Filing Date | Publication Date | Applicant/Title |
|---|---|---|---|
| U.S. Pat. No. 7,188,435 B2 | 20 Jul. 2005 | 30 Mar. 2007 | Bonnie E. Woolsten, Alan E. Young/ Knock-down type dryer assembly for prosthesis liners. |

This design does not provide well directed airflow, the ability to dry multiple socks at one time, and could stretch or deform socks while mounting or removing.

SUMMARY

A stump sock dryer is designed to rapidly move air through silicone stump socks quickly drying them. The stump sock dryer includes a fan capable of moving air. Air is moved through a duct, into multiple tubes. Air moves from the tubes, through the nozzles into the stump sock. Air flows through the entire inside length of the socks. This provides gentle and thorough drying of the stump socks. The air tubes and the nozzle with rollers allows the socks to be mounted and dismounted with little resistance and no damage to the sock. The user can easily slide the socks down over the nozzles and air tubes. With the socks in place and the fan turned on the socks will be dried in the best manner possible.

What is claimed is:

1. A machine for drying the inside of amputee stump socks comprising:

1. a ducting system for directing air into stump socks,
2. a fan for moving air through ducting,
3. air tubes to direct air from duct through nozzles, and
4. nozzles with rollers, mounted on air tubes, to allow gentle placement of stump socks onto the machine preserving stump sock material and shape.

* * * * *